United States Patent [19]

Agent et al.

[11] 4,077,180

[45] Mar. 7, 1978

[54] METHOD AND APPARATUS FOR PACKAGING FLUENT MATERIAL

[75] Inventors: J. Richard Agent, Crete; Donald W. Nielsen, Park Forest; Thomas A. Cooper, Chicago Ridge, all of Ill.

[73] Assignee: Portion Packaging, Inc., South Chicago Heights, Ill.

[21] Appl. No.: 696,932

[22] Filed: Jun. 17, 1976

[51] Int. Cl.[2] ..... B65B 3/12; B65B 3/32; B65B 7/28

[52] U.S. Cl. ..... 53/37; 53/282; 53/329; 141/186; 198/834; 221/223

[58] Field of Search ..... 53/282, 329, 37; 141/129, 135, 178, 186; 198/834; 221/223

[56] References Cited

U.S. PATENT DOCUMENTS

| | | | |
|---|---|---|---|
| 3,112,590 | 12/1963 | O'Brien | 53/282 |
| 3,775,934 | 12/1973 | Smith | 53/282 X |
| 3,908,342 | 9/1975 | Raque | 53/329 |

*Primary Examiner*—Travis S. McGehee

*Attorney, Agent, or Firm*—Robert E. Wagner; Robert E. Browne

[57] ABSTRACT

A method and apparatus for packaging fluent material in individual containers, including a dispensing mechanism for locating individual containers in transverse rows on a moving conveyor belt, a filling pump assembly for simultaneously filling individual cups located in a series of such transverse rows with a predetermined amount of such fluent material during the movement of the conveyor, a covering assembly for applying strips of preformed covers to a plurality of filled individual containers simultaneously, and thereafter fluid-tightly sealing such covers to the containers, and a severing assembly including a series of rotating knives for severing the covers so applied to form individual filled and sealed containers.

27 Claims, 16 Drawing Figures

FIG. 2
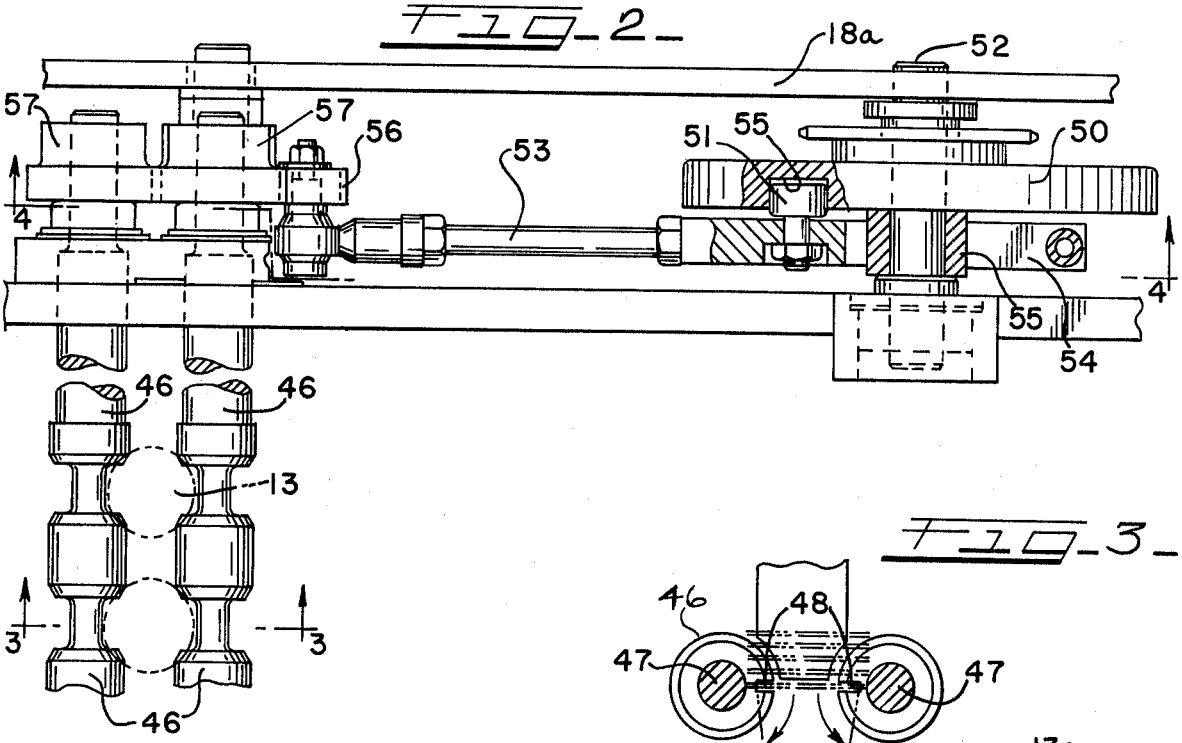
FIG. 3
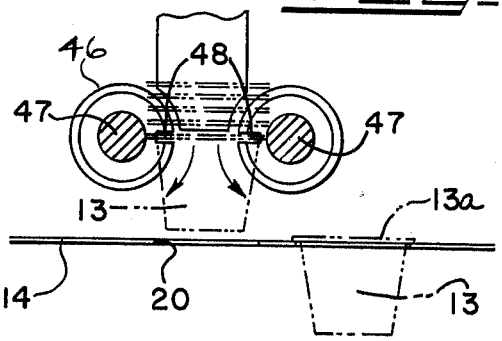
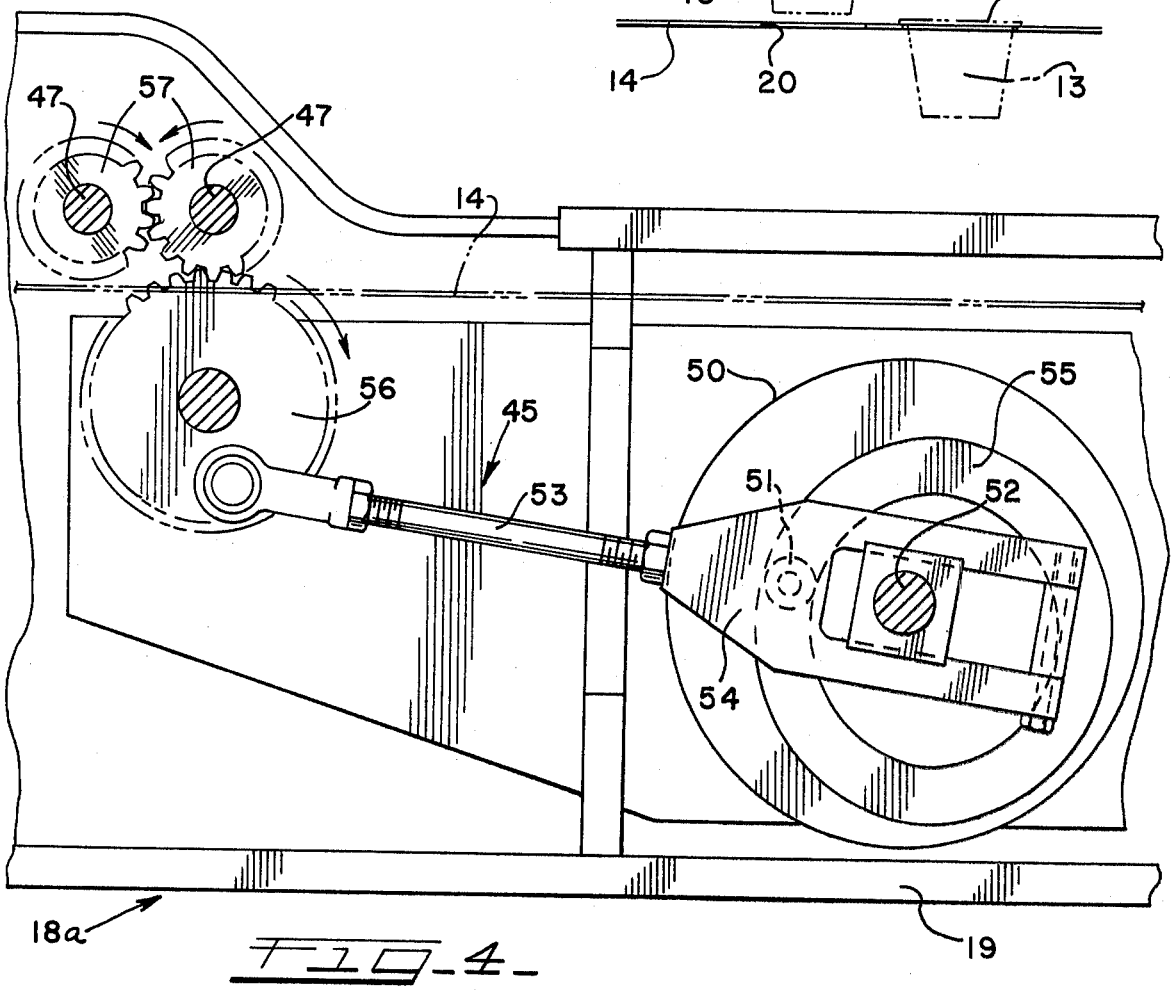
FIG. 4

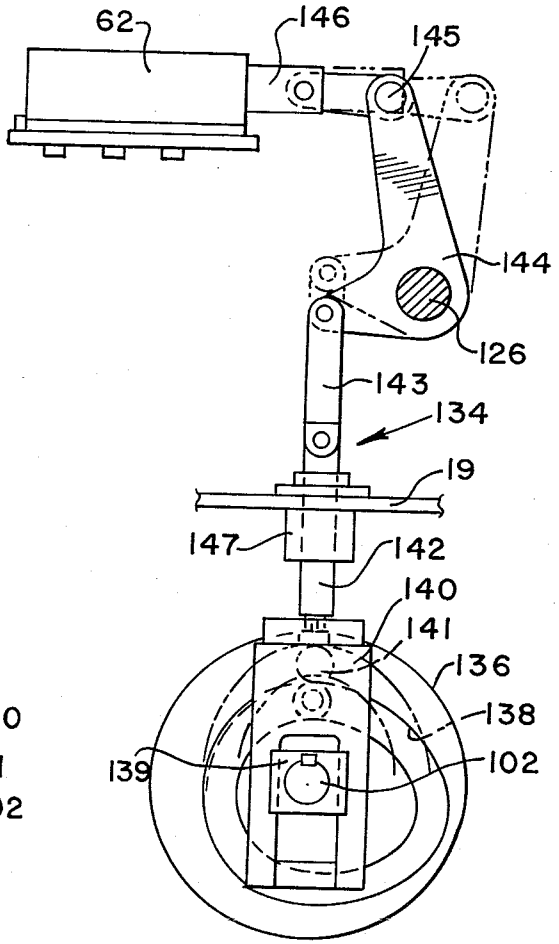
FIG. 11
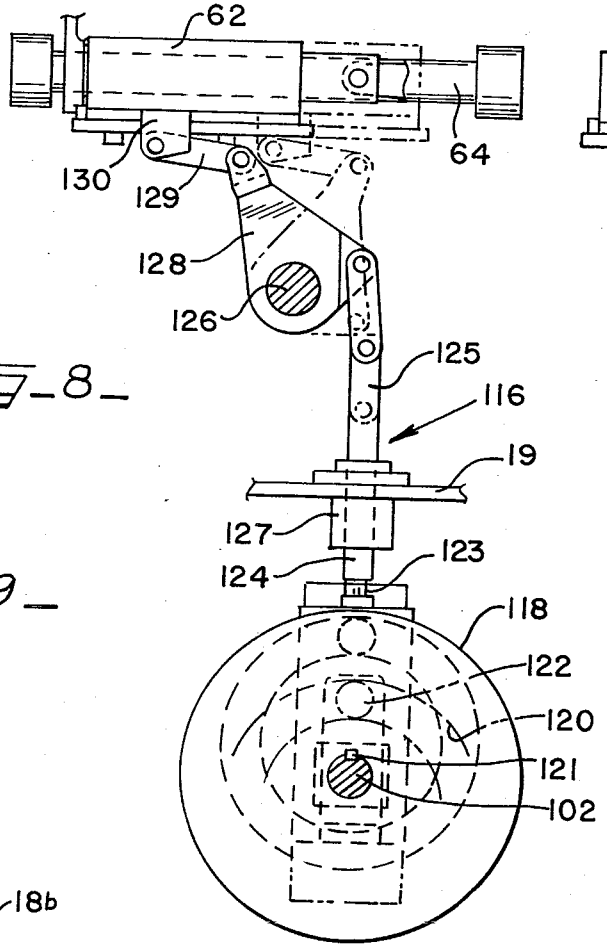
FIG. 10
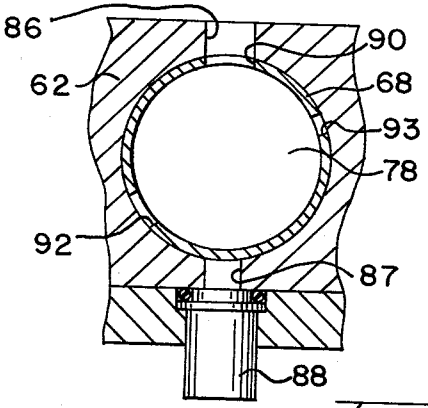
FIG. 8
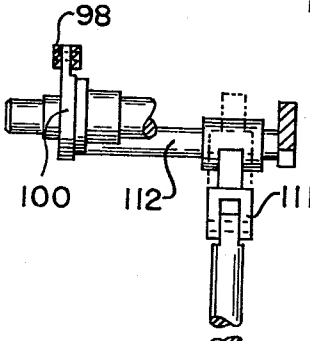
FIG. 9
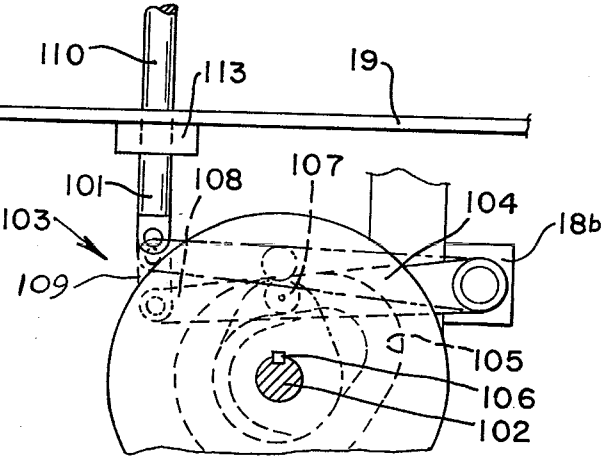

METHOD AND APPARATUS FOR PACKAGING FLUENT MATERIAL

BACKGROUND OF THE INVENTION

This invention relates to a method and apparatus for packaging fluent material such as liquids and, in particular, to the rapid filling and sealing of inexpensive, disposable individual containers with metered amounts of such liquids.

The use of individualized servings of such commonly used liquids as cream, milk, salad dressing and the like in restaurants and by airlines in disposable packages has become highly desirable because of the great convenience and cleanliness offered by such packaging. It is necessary, however, that the packaging of the individual servings of fluent material, such as cream or milk, in plastic or paper containers be accomplished under sanitary conditions and in a fast, inexpensive, continuous process with a minimum of handling and spillage. Various methods and apparatus have been designed for accomplishing such results. Two such packaging apparatus and methods are shown in U.S. Pat. No. 3,775,934 to Louis W. Smith, issued Dec. 4, 1973, and U.S. Pat. No. 3,440,794 to Martin Mueller, issued Apr. 29, 1969. The packaging apparatus represented by the above patents, and other apparatus presently used, generally include a conveyor belt for carrying empty containers for the liquid to be packaged, a dispenser for depositing such empty containers on the belt at a first station, a mechanism for filling each container with a desired amount of liquid, and a capping device for applying a fluid-tight cover to the filled container prior to its discharge from the belt.

While most present packaging apparatus perform the basic filling and capping functions, they have certain limitations which have restricted their performance. For example, many present packaging machines require the conveyor belt to be intermittently started and stopped, as, for example, at the filling station. This consumes time and reduces output. Those packaging machines which use a continuously moving belt, such as Mueller, are limited because they are only able to fill a single row or line of containers simultaneously. This limitation also restricts the maximum output of the machine. For example, the machine shown in U.S. Pat. No. 3,775,934 has a maximum output of approximately 300 cups per minute.

Another problem in present machines has been to provide reliable, fluid-tight sealing of the cover to the filled container. This is presently accomplished, as shown in Smith, by a rather long series of heater plates and rollers, which do not always achieve satisfactory results because they only heat the covering material for a brief time after its application to the filled containers.

SUMMARY OF THE INVENTION

The method and apparatus for packaging fluent material, as set forth in the present invention, are designed to overcome the limitations inherent in the construction of previous packaging machinery. In this invention, an endless belt conveyor formed of a metallic material, such as stainless steel, is provided with a plurality of rows of openings, each opening being adapted to receive an open top container. This conveyor belt is supported, at its opposite ends, by a drive pulley and an idler pulley. The drive pulley includes a pair of drive sprockets which engage the belt, separated by a free running drum, which takes up the belt tension and prevents its lateral movement. A row of container dispensing chutes is located above one end of the conveyor belt, each chute holding a stack of open top containers for each opening of a row on the belt. A pair of parallel, oscillating dispensers releases the bottom container from each stack in each chute simultaneously so that a row of containers drops into a row of openings in the conveyor as the openings move under the chute. The conveyor belt is moved continuously to carry the rows of containers past a filling station, a cover applying station, and a severing station to complete the packages, which are then discharged from the conveyor.

The filling station or filling pump assembly includes an outer housing mounted across the conveyor and movable along rails at the same speed as the conveyor belt. This housing has a number of side-by-side cylindrical bores formed in it, each of which receives a cylindrical pumping cartridge. A piston is inserted into an open end of each pumping cartridge. The piston and the interior walls of the cartridge have corresponding stepped portions and define a series of separate chambers, having equal volumes, within each cartridge. The piston moves in a direction parallel to the housing at a lower rate of speed than the housing. The pump cartridge is rotatable within the housing to act as a sleeve valve to obtain filling and discharge of the cartridge at the desired times. The separate chambers within each cartridge are filled with the fluid material, which is then ejected from the housing into a number of individual containers passing underneath the housing on the conveyor belt simultaneously. The movement of the housing, the cartridge and the piston forming this unique filling pump is timed relative to one another by a series of cams mounted on a single shaft. The use of this unique filling pump assembly allows any desired number of rows of containers to be filled simultaneously, thereby significantly increasing output.

The covering or capping station includes a heating drum about which a series of covers in interconnected strip form are wound, heated and fed toward the filled containers. The covers are applied to each container in a row on the conveyor simultaneously, and then rolled by rollers to seal the caps to the upper flange or lip of each container. A series of rotary knives sever the interconnected caps such that discrete individual serving containers of the fluid material are formed. The containers are then discharged into a suitable receiving means for packaging and delivery.

The entire packaging process is automatic and may be carried on continuously at high speed without any manual intervention. To even further reduce the operator time required in connection with the presently disclosed packaging method and apparatus, Applicants have developed a feeder assembly, which provides a constant supply of containers and the like for the container chutes. This feeder assembly is the subject of a separate and concurrently filed U.S. patent application, Ser. No. 698,484, filed June 21, 1976 by J. Richard Agent, Donald W. Nielsen and Thomas A. Cooper, entitled "Feeder Assembly".

The conveyor belt, container dispenser, filling pump assembly, covering assembly and severing assembly are all operated from a single drive motor mounted below the conveyor on the frame of the packaging machine. Their speed of operation is independently controlled in their operation through various reducing gears and a series of inter-related cams, which time the movements of the relative conveying, dispensing, filling and cap applying assemblies in relationship to one another, as will be explained in considerable detail below.

It has been found that use of the present invention will approximately double or triple the output of filled, individual serving containers produced by present packaging machines.

Accordingly, it is an object of the present invention to provide a method and apparatus for packaging fluent material in individual, disposable containers.

It is a further object of the present invention to provide a method and apparatus for packaging fluent material which allows a plurality of containers located on a moving conveyor belt to be filled simultaneously.

It is also an object of the present invention to provide a method and apparatus for packaging fluent material, having a container dispensing apparatus which operates in a harmonic, oscillating manner to increase operating efficiency.

It is a further object of the present invention to provide a method and apparatus for packaging fluent material having an improved means for heat sealing covers to a plurality of individual, filled containers simultaneously.

It is one more object of the present invention to provide a method and apparatus for packaging fluent material having a means for driving the conveyor belt which permits adjustment but prevents lateral movement of the belt.

These and other objects of the present invention will become evident from the following description of the drawings illustrating a preferred embodiment, wherein:

BRIEF DESCRIPTION OF THE DRAWINGS

FIG. 2 is a top view of a portion of the packaging apparatus of the present invention taken generally along line 2—2 in FIG. 1, showing the cup dispensing cam assembly connected to the cup dispenser assembly;

FIG. 3 is an elevational cross-sectional view of the cup dispenser rollers of the present packaging apparatus taken generally along line 3—3 in FIG. 2;

FIG. 4 is a rear elevational cross-sectional view of the cup dispensing cam assembly of the present packaging apparatus taken generally along line 4—4 in FIG. 2;

FIG. 8 is an end cross-sectional view of an isolated filling pump cartridge of the present invention showing the valve openings controlling filling and discharge, taken generally along line 8—8 in FIG. 7;

FIG. 9 is an isolated rear elevational view of the rotary valve cam assembly, which rotates the pump cartridge in the present invention and which is taken generally along line 9—9 in FIG. 5;

FIG. 10 is an isolated rear elevational view of the housing cam assembly of the present invention, taken generally along line 10—10 in FIG. 5;

FIG. 11 is an isolated rear elevational view of the pump piston cam assembly of the present invention, taken generally along line 11—11 in FIG. 6;

DETAILED DESCRIPTION OF THE INVENTION

Figure 1:
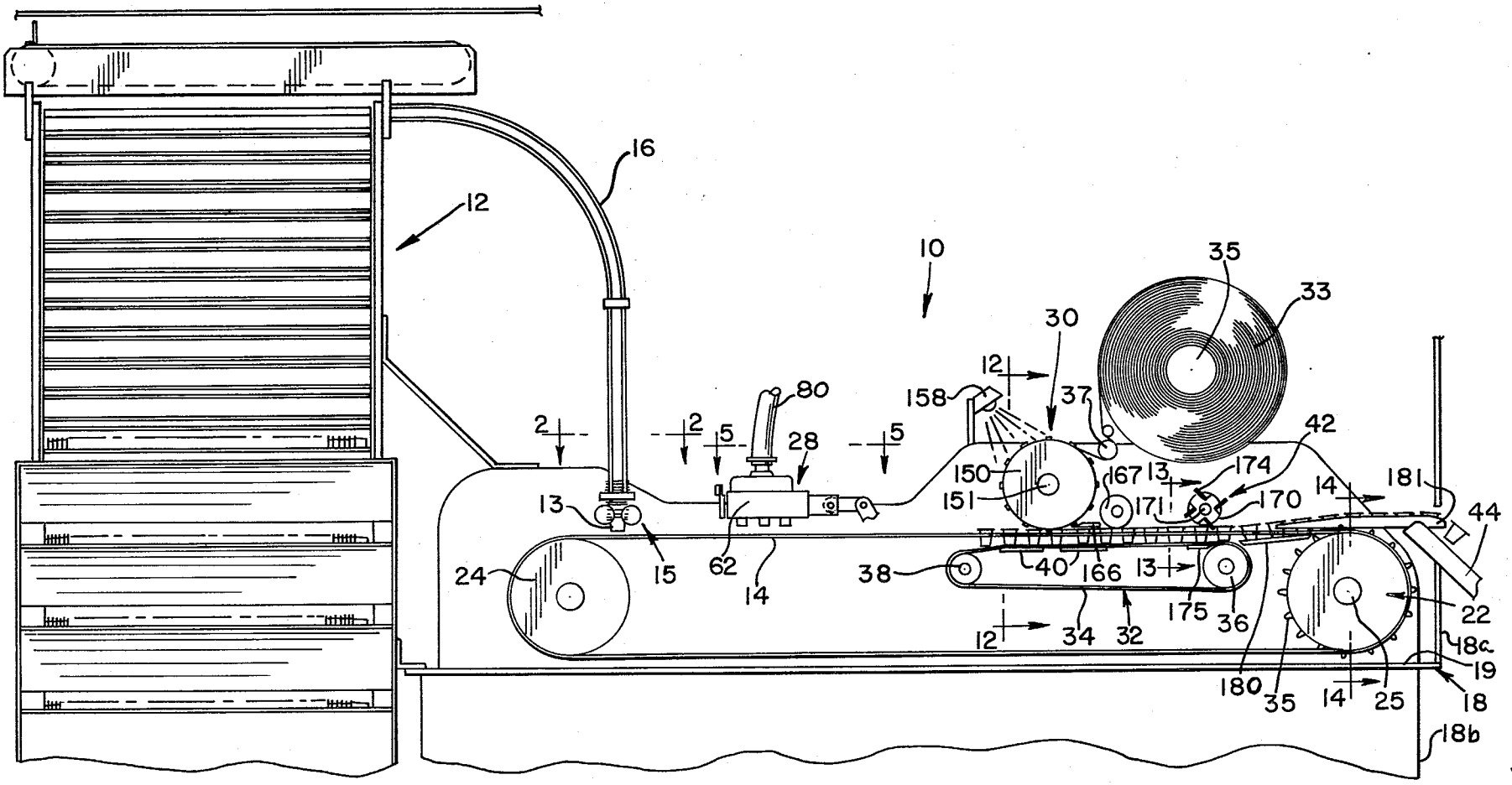
FIG. 1 is a front elevational view of the packaging apparatus of the present invention shown as used in combination with the feeder assembly, which is the subject of our co-pending patent application.

Referring now to the drawings and, in particular, to FIG. 1, the packaging apparatus of the present invention is shown in general at 10. In connection with this packaging apparatus, there is also shown a cup or container feed apparatus 12, which is the subject of Applicants' copending application, U.S. Ser. No. 698,484, filed June 21, 1976 for a Feeder Assembly. The purpose of the cup feed is to feed a constant supply of containers, such as the plastic cups which are to be filled with a desired fluent material, such as cream, milk or salad dressing, to the packaging apparatus 10. Cups are fed from the feed apparatus 12 to the inbound end of an endless belt conveyor 14 of the packaging apparatus by means of a number of side-by-side chutes 16. In the preferred embodiment, the number of chutes 16 placed in adjacent side-by-side relationship will correspond to the number of openings to receive cups formed in the conveyor 14, which constitute a row of the conveyor, as will be explained below.

Figure 5:
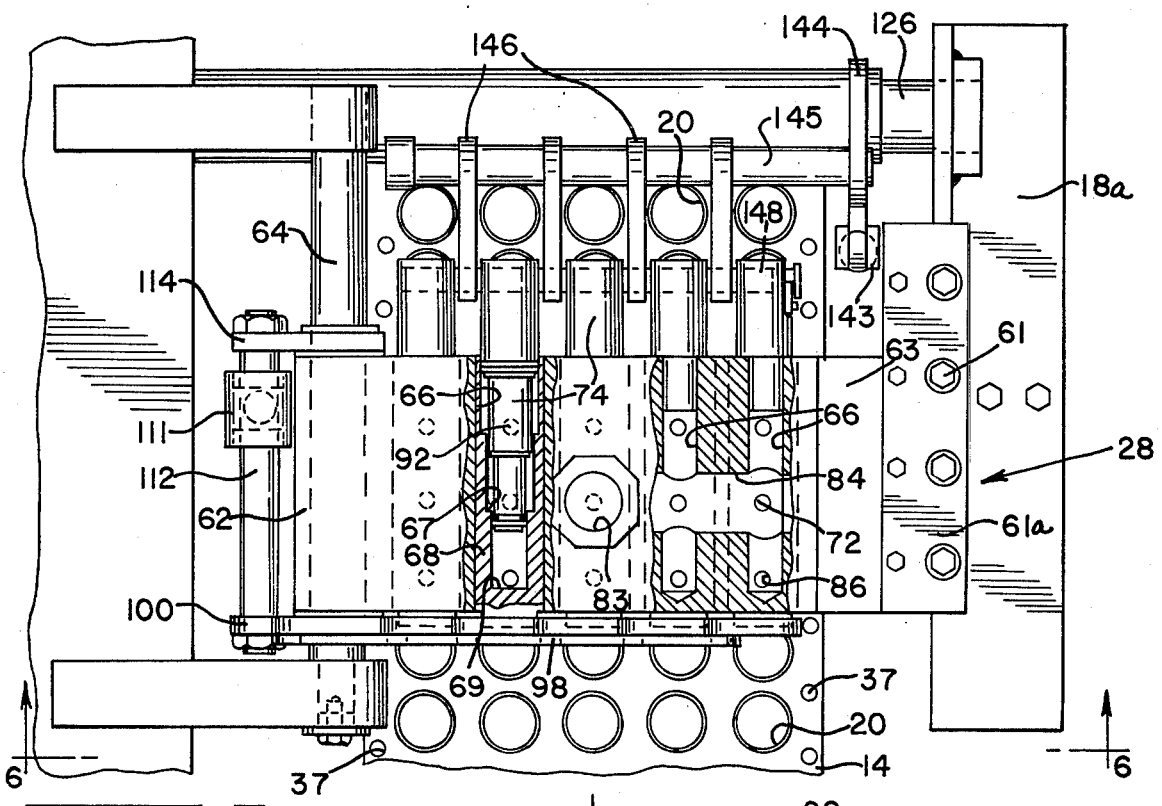
FIG. 5 is a top view of the filling pump assembly of the present packaging apparatus taken generally along line 5—5 in FIG. 1, the elements of the filling pump assembly being shown in partial cut-away views to expose the interior of the pump cartridge.

The packaging apparatus 10 of the present invention includes a frame 18, having an upper portion **18*a* and a base or a lower portion 18*b* separated by base top 19. The upper frame 18*a* supports an endless conveyor belt 14 for continuous movement relative to a number of operating stations located along the path of travel of the belt. At each of these stations, a specific operation is performed on cups located on belt 14, to fill the cup with the desired fluent material, seal it, and finally discharge it into a container or other suitable machinery to package the cups for shipment. The conveyor belt 14 is preferably formed of a thin material having high tensile strength, which is easily cleaned, such as stainless steel. As shown in FIG. 5, the conveyor belt 14 has a series of equally-spaced circular openings 20 which are aligned transversely across the conveyor belt 14 with, in the preferred embodiment, five openings forming a single row. Rows of such openings are equally spaced longitudinally along the entire length of the belt, as shown in FIG. 5. The ordered arrangement of openings 20** may be described as forming transverse rows and longitudinal columns.

Figure 6:
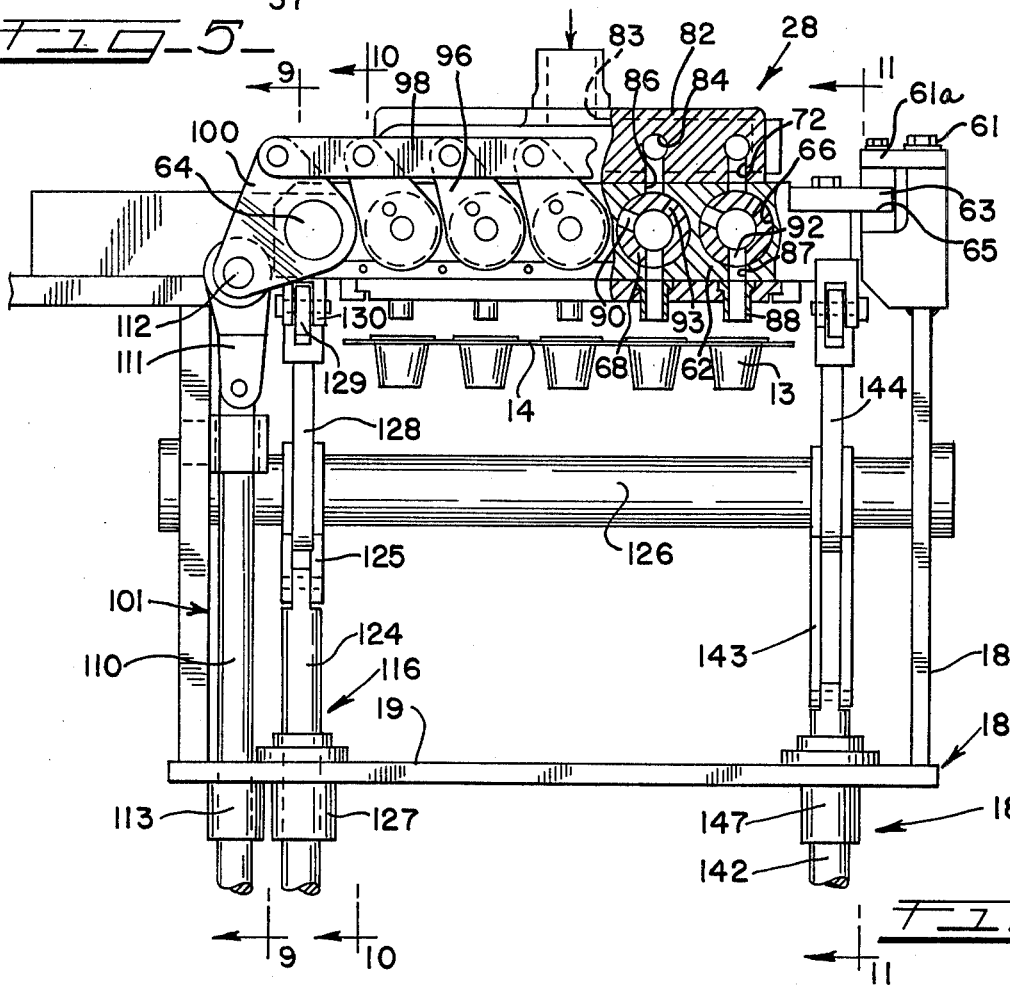
FIG. 6 is an end elevational view of the filling pump assembly of the present invention taken generally along line 6—6 in FIG. 5, including a portion of the rotary valve cam assembly used to operate filling and discharge of the pump cartridge.

The cups 13 to be filled are fed from the chutes 16 in such a manner, as will be explained below, that a single cup 13 is placed in each opening 20 of a row simultaneously. These cups 13 have a uniform frusto-conical cross section, as shown in FIG. 6, and have an upper flange or lip 13*a* which is slightly larger in outside diameter than the diameter of the opening or hole 20 in the conveyor belt 14 in which the cup is placed, so that the conveyor supports each cup by its upper lip.

The conveyor 14 itself is supported, at its opposite ends, around a drive pulley assembly 22 and an idler drum 24. The drive assembly 22 and the conveyor belt 14 are driven by a motor 26, shown in FIG. 15, which is mounted on the base 18*b* and operatively connected to the drive pulley by means described below.

The path of travel of the conveyor belt 14 takes each row of cup openings 20 past the operating stations along the length of the belt. The first of these stations is the filling station, at which the cups positioned within the conveyor openings are filled with a metered amount of the fluent material to be packaged. At this filling station, a filling pump assembly, shown in general at 28, acts in a novel manner to simultaneously fill a plurality of adjacent consecutive rows of cups riding in the conveyor simultaneously.

The filled cups are then advanced toward a cover applying station, including a covering assembly, shown in general at 30, at which a series of interconnected, preformed covers are applied over the upper lip 13*a* of each filled container. These covers are supplied by a number of adjacent reels 33, mounted on a common central axis, which correspond in number to the number of openings forming a single row of the conveyor. To facilitate the covering application, the bottoms of the cups which are being advanced by the conveyor belt 14, encounter the upper surfaces of a series of side-by-side ribbon conveyors 32, which are supported by first and second pulleys 36 and 38. These ribbon conveyors are slightly raised by a ramp 40 and act to vertically lift each row of cups slightly above the surface of conveyor belt 14 to assure positive contact between the entire surface of the upper cup lip and the cap or cover applied to it by the covering assembly 30.

At the final station in the process, the covered cups, which are now interconnected by the caps applied to them, have the interconnecting webs of the covers severed to form individual packaged units by a severing assembly 42. The cups are then moved over a series of inclined discharge ramps at the discharge or outward end of the conveyor into suitable means for gross packaging.

Referring now with more particularity to the several novel features of the present invention, each cup must necessarily be placed precisely in a corresponding receiving opening 20 in the conveyor belt 14 in order to eliminate waste of fluent material and malfunctioning of the machine. As the cups are advanced at a uniform rate of speed by the conveyor belt 14, driven by the motor 26, new cups are being continuously placed in available empty openings in the conveyor belt by a double roller dispenser apparatus, shown generally at 15 in FIG. 1, and in more detail in FIGS. 2–4.

This dispenser 15 includes a pair of spaced apart, generally parallel rollers 46, which pivot about similarly spaced central axes 47 parallel to the surface of conveyor belt 14. These rollers 46 are formed in the shape of spindles, that is, having reduced diameter portions to receive the bottommost cup in each stack of cups supplied by the cup feed chutes 16. Corresponding inwardly facing notches 48 are formed in inward corners of the perimeter of the enlarged diameter portions of each roller, as shown in FIG. 3. These notches engage the upper, outwardly extending lip 13*a* of each cup 13 so that as rollers 46 are rotated upwardly on opposite directions, they engage the lip 13*a* of the bottom cup 13 in each stack, and denest or remove it from the supply stack. As rollers 46 are rotated in a reverse direction, as shown by the arrows in FIG. 3, they carry the denested cup as shown in FIG. 3, until the notches separate sufficiently that the cup is deposited in a corresponding opening 20 formed in the conveyor belt 14. The cup dispensing rollers 46 are driven in the above-described oscillating motion by a cam arrangement 45, shown in FIG. 4, which is operated from the main drive motor 26. The drive motor 26 directly operates a series of drive shafts and drive belts, including various reducing gears and pulleys, which will be explained in detail below, to drive each particular operation of the packaging apparatus. By use of a single drive, the several operations involved in this packaging apparatus may be coordinated in speed and timing relative to one another.

Figure 15:
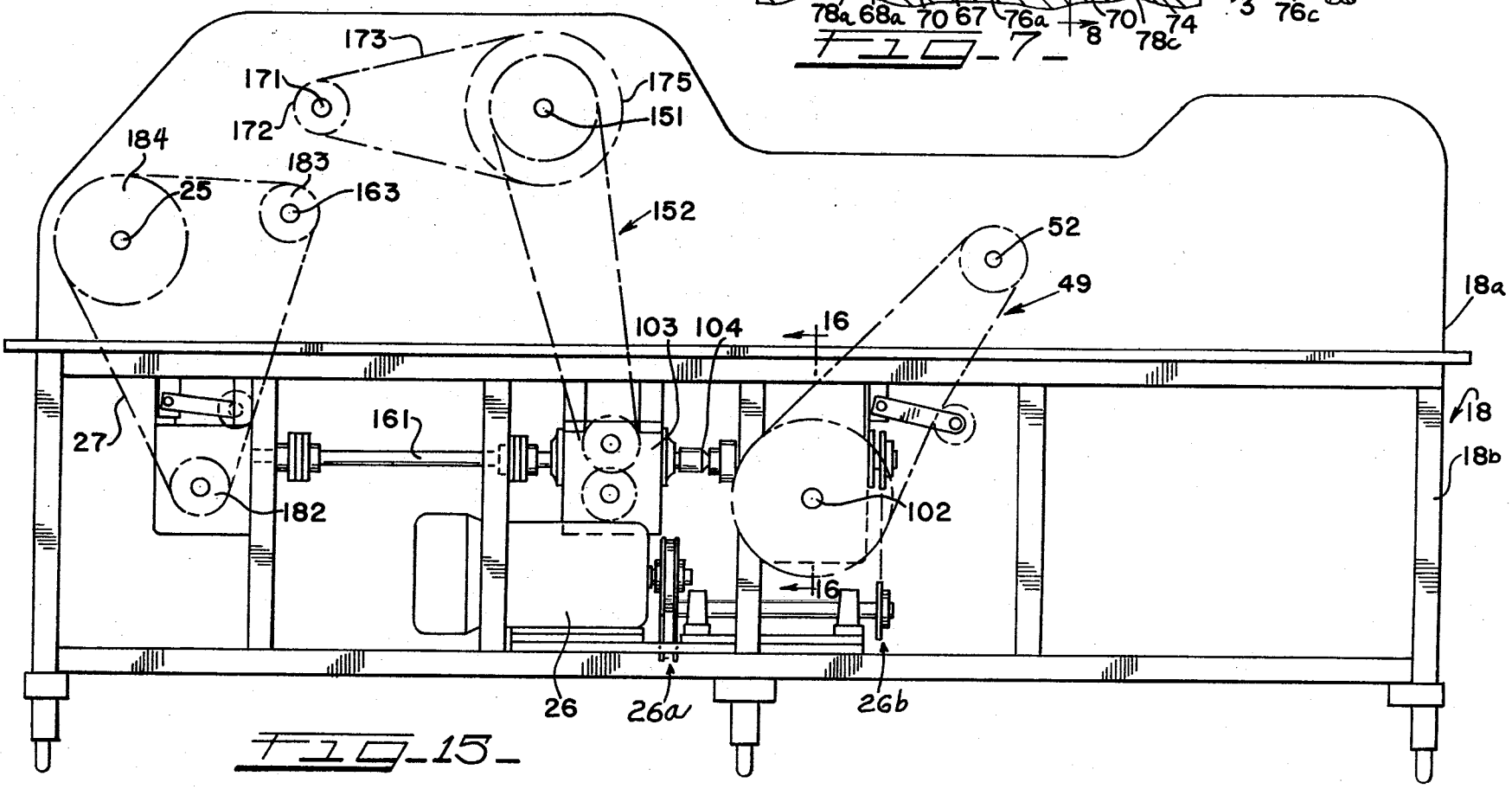
FIG. 15 is a rear elevational view of the packaging apparatus of the present invention, showing the operative connections of the drive motor to various driven elements; and, FIG. 16 is an end cross-sectional elevational view of the cams which operate the filling pump assembly of the present invention, in operative relationship.

For example, the drive motor 26 is connected by means of a conventional belt and pulley 26*a* and chain and sprocket 26*b*, as shown in FIG. 15, to gear reducer 103 through transmission shaft 104, shaft 102 and chain and sprocket assembly 49, which drives a cup dispenser cam shaft 52 mounted in the sides of the upper frame 18*a*, as shown in FIG. 4. A cup dispenser cam 50 is mounted on shaft 52 for rotation therewith. Cam 50 engages a cam follower 51 which is fixedly mounted on a yoke portion 54 of a drive rod 53. The legs of yoke portion 54 are located on opposite sides of shaft 52 to permit drive rod 53 to reciprocate relative to that shaft. The opposite end of the drive rod 53 is pivotally pinned near the outer edge of a drive gear 56 having a number of teeth formed in its upper periphery. The teeth on gear 56 engage corresponding teeth on the periphery of one of two similar cup roller gears 57 mounted near the inward ends of the cup release rollers 46. The cam follower 51 on the drive rod 53 engages a recessed cam track 55 formed into an outwardly facing surface of cam 50 in a desired shape. As the larger radius portion of the cam track 55 is rotated against the cam follower 51, gear 56 will be moved in the direction of the arrow in FIG. 4 to rotate the cup release rollers 46 downwardly, as shown, and quickly drop the bottom cup in the stack by gravity onto the belt 14. Cam track 52 is uniquely shaped so that follower 51 will move the drive rod 53 and gear 56 by a long, generally spiral portion of track 55 to deliver the cup accurately and rapidly in the opposite direction, while reciprocating the rollers upwardly to engage the next cup very rapidly. Thus, by means of the cam 50, the cup release assembly operates with a deliberate delivery to assure proper placement of a plurality of cups simultaneously in the adjacent openings 20 forming a row in belt 14, then returning the rollers to their initial position with great speed, to allow delivery of 200 or more rows of cups per minute to the conveyor belt 14.

In the embodiment shown in the drawings, five cups are dropped or released by the cup dispenser 15 into the openings 20 formed transversely in the conveyor belt 14 to form a complete row. The cup dispenser operates with sufficient speed that it accurately drops five cups into each consecutive row of openings formed in the conveyor as these openings pass beneath the rollers 46. The cups to be filled are then advanced with the conveyor belt 14 toward the filling station, which is shown in detail in FIGS. 5–11.

The filling pump assembly 28 is mounted on the upper frame 18*a* and operated by a filling pump assembly drive 16 mounted on the lower frame 18*b* and shown in more detail in FIGS. 9–11 and 16.

The novel filling pump assembly 28 itself includes three independently movable elements which cooperate to deliver a metered amount of fluent material to a plurality of rows of cups passing beneath it on the continuously moving conveyor simultaneouly. These cooperating elements include a housing 62, which is mounted transversely across the conveyor belt 14 and suspended in parallel relationship to the top surface of the conveyor a selected distance above such surface. This rectangular housing 62 is slidably mounted about a shaft 64 on one side and has a flange 63, which engages a linear track 65 in frame 18*a*, on its opposite side. For repair and maintenance, the bolts 61 may be loosened, top plate 61*a* removed, and the entire housing 62 rotated about shaft 64 in the manner of a hinge, to be lifted away from the top of the conveyor 14.

Figure 7:
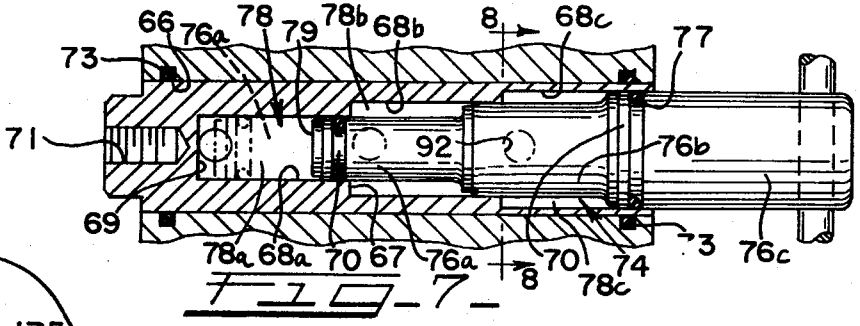
FIG. 7, on sheet 6, is an isolated cut-away view of one of the plurality of filling pump cartridges and pistons in the present invention.

Housing 62 has a series of hollow, generally cylindrical bores 66 formed within it, as shown in FIGS. 5 and 7. In the embodiment described herein, the housing 62 includes five parallel bores 66 disposed in side-by-side relationship transversely to the path of the conveyor. Each bore 66 in housing 62 is adapted to receive, in close-fit relationship within it, a second movable element which is a pumping cartridge 68 having a smooth cylindrical exterior surface and a hollow interior formed in a series of distinct cylindrical segments, formed by increasing or stepped cross-sectional diameters. Each cartridge 68 has an end wall 69 and an opposite, open end.

The stepped segments of each cartridge 68 form a series of shoulders 67, which differentiate and separate the cylindrical segments of each cartridge 68 and cooperate with a third element in the filling assembly 28, namely piston 74. As shown in FIG. 7, this piston 74 is formed by a series of cylindrical portions of increasing or stepped cross-sectional diameters generally corresponding to but slightly smaller in dimension than the stepped diameter segments of the pumping cartridge 68. The various stepped diameter portions of the piston 74 are disposed for movement within stepped diameter segments of cartridge 68 having corresponding diameters. That is, the smallest diameter piston portion, such as 76*a*, is adapted to reciprocate into and out of the smallest diameter cartridge segment, such as 68*a*. When a piston 74 is inserted into a cartridge 68 in a withdrawn or first position, as shown in FIG. 7, the stepped piston portions cooperate with the interior side walls of the segments of cartridge 68 to define a series of fluid containing chambers 78, within each cartridge 68.

The maximum volume of each chamber 78 will correspond to the exact metered volume of fluent material, such as cream or milk, which is desired to be dispensed into the cups on the conveyor. With the piston in a first or withdrawn position, the piston portion 76*a*, which will fill the forward segment 68*a* of cartridge 68, will be withdrawn to define a chamber 78*a*. The volume of chamber 78*a* is equal to $\pi$ times the radius of the cartridge segment squared times the distance between the end wall 69 and the facing wall 79 of the piston segment 76*a*. This volume is that selected for the amount of fluent material to be metered into each cup. Chamber 78*b*, as shown in FIG. 7, will have a volume determined by adding the volume of piston portion 76*a* to the volume of cartridge segment 68*a*. Taking a radius in excess of that of cartridge segment 68*a* and knowing $\pi$, the required length of the cartridge segment 68*b* may be easily calculated. The length or the radius may be changed as desired in order to give the proper volume. The volume 78*c* of the third segment 68*c* may be calculated in a similar fashion. If desired, each cartridge 68 could be divided into even further steps which receive corresponding piston portions.

Grooves 70 are formed near opposite ends of each piston 76 and receive O-rings or similar suitable sealing means 77, which engage the cylindrical sides of the cooperating cartridge segment to maintain alignment between the cartridge and piston, prevent metal-to-metal contact and provide a fluid-tight seal at the rear of the piston.

Each pumping cartridge 68 is inserted into the receiving bore 66 formed in the housing 62. The inward, closed end of each cartridge 68 will extend slightly beyond the housing 62 through an opening formed in that end of the housing, as shown in FIG. 7. This inward end has a threaded bore 71 formed in it for connection to the valve operating mechanism, which will be discussed below. The exterior dimension of the pumping cartridge 68 is slightly less than the bore 66. Sealing means 73, such as Teflon coated O-rings or the like, are disposed within grooves formed in the interior wall of the bore 66, at opposite ends thereof, to engage pumping cartridge 68 and resist its linear movement, assure fluid-tight seal but allow sufficient angular movement of the pumping cartridge to provide for filling and discharge of the cartridge, as wili be described.

Mounted on the top surface of the housing 62 is a manifold 82, as shown in FIG. 6, which has a central upper opening 83 in communication with a source of fluent material, which enters in the direction of the arrow, as shown in FIG. 6, through a flexible tube or hose 80. The manifold acts in a conventional manner to distribute the incoming fluid through a series of internal passageways 84 to each of an arrangement of openings 72 formed in the bottom of manifold 82. These openings 72 are aligned and in communication with similar openings 86 formed in the upper portion of housing 62, which open into the interior of each receiving bore 66 formed in housing 62. In the preferred embodiment, there are three rows of such openings 72 and 86, each row consisting of five openings, corresponding in number and location, that is, in the distance they are spaced apart transversely and longitudinally, to the centers of the openings 20 formed in conveyor belt 14. The housing 62 also has a number of lower openings 87 vertically aligned with upper openings 86 which, in turn, are connected to a corresponding number of delivery tubes 88. Each delivery tube 88, which is open at its lower end, ends a short distance above the open top of a cup carried on the conveyor belt 14.

Each pumping cartridge 68 inserted into a receiving bore 66 in housing 62 is rotatable relative to the bore and the housing. As shown in FIGS. 6 and 8, each stepped segment of pumping cartridge 68, which forms a separate chamber 78, is provided with three separate ports formed through the walls thereof. When each pumping cartridge 68 is properly located in a bore 66 in housing 62, these ports will be in the same vertical planes as the openings 86 and 87 formed in housing 62 to allow fluent material to be received into or discharged from the interior of the pumping cartridge, and also allow the interior to be cleaned. As shown in FIG. 6, these ports, which will be referred to as the intake port 90, discharge port 92 and clean-out port 93, are disposed in the same vertical plane angularly around the circumference of the pumping cartridge 68 such that no two ports formed in any segmented section of the cartridge are in communication with more than one of the openings, either 86 and 87, formed in the housing 62 at any one time, except for cleaning.

In this manner, when the pumping cartridge 68 is rotated to align the three intake ports 90, formed in it, with upper housing opening 86, to allow the fluent material being distributed through the manifold 82 to enter the separate chambers 78, defined by each stepped diameter section of cartridge 68, discharge port 92 of cartridge 68 and the clean-out port 93 are closed, as shown in FIG. 8. Likewise, after filling, the entire cartridge 68 is moved in a counterclockwise direction until the discharge ports 92 in each cartridge are aligned with the lower opening 87 in the housing to deliver the fluent material to the cups beneath. For cleaning, the cartridge may be rotated slightly further by hand, to align port 93 with opening 86 and part of port 92 with opening 87, to allow the stainless steel interior of cartridge 68 to be washed, rinsed or sterilized.

Each of the above-described ports in each pumping cartridge 68 is disposed within each bore 66 at identical angles respective to the housing 62. When positioned in this manner, each cartridge 68 may be connected to an individual valve arm 96 by means of a threaded connector mounted on such valve arm, which threadedly engages the forward threaded opening 71 formed in cartridge 68. As the valve arm 96 is pivoted, the cartridge 68 will move with it. An upper end of each valve arm 96, having a reduced radius portion, is connected to an elongated link arm 98. This link arm connection allows all of the valve arms, and thereby all of the pumping cartridges, to be moved angularly with respect to the housing 62 to an identical degree, simultaneously. The end of the link arm 98 toward the rear of the packaging machine is, in turn, pivotally pinned to a triangular-shaped crank member 100. One corner of crank member 100 is mounted over circular shaft or rail 64, on which the entire filling pump assembly 28 reciprocates along the path of travel of the conveyor. An upper corner of crank member 100 is pivotally pinned to the link arm 98 in a lower corner. Thus, the angular movement of the crank member plate causes linear movement of link arm 98 and angular movement of valve arms 96. This movement causes the pumping cartridge 68 itself to be moved angularly relative to the housing 62 in such a manner that the ports formed in the pumping cartridge may be aligned, as desired, with the openings formed in the housing to open or close communication between the interior of the pumping cartridge and the source of fluent material or the delivery tubes.

In this manner, the pumping cartridge 68 functions as a sleeve valve. This valving operation is controlled by a rotary valve cam assembly 101 mounted beneath the top of the main base 19 on lower frame **18*b*, and operatively connected to crank member 100. Likewise, a housing cam assembly 116 is mounted on base 18*b* and connected to housing 62 to move it, and pumping cartridges 68, reciprocally along the path of travel of the conveyor belt 14, at the same speed as the conveyor belt. Similarly, the stepped pistons 74 themselves are being independently reciprocated within their cooperating pumping cartridges by piston cam assembly 134, which is operatively connected to the series of pistons mounted on the upper frame 18*a***. Each of these cam assemblies and their related functions will now be described in detail.

Figure 16:
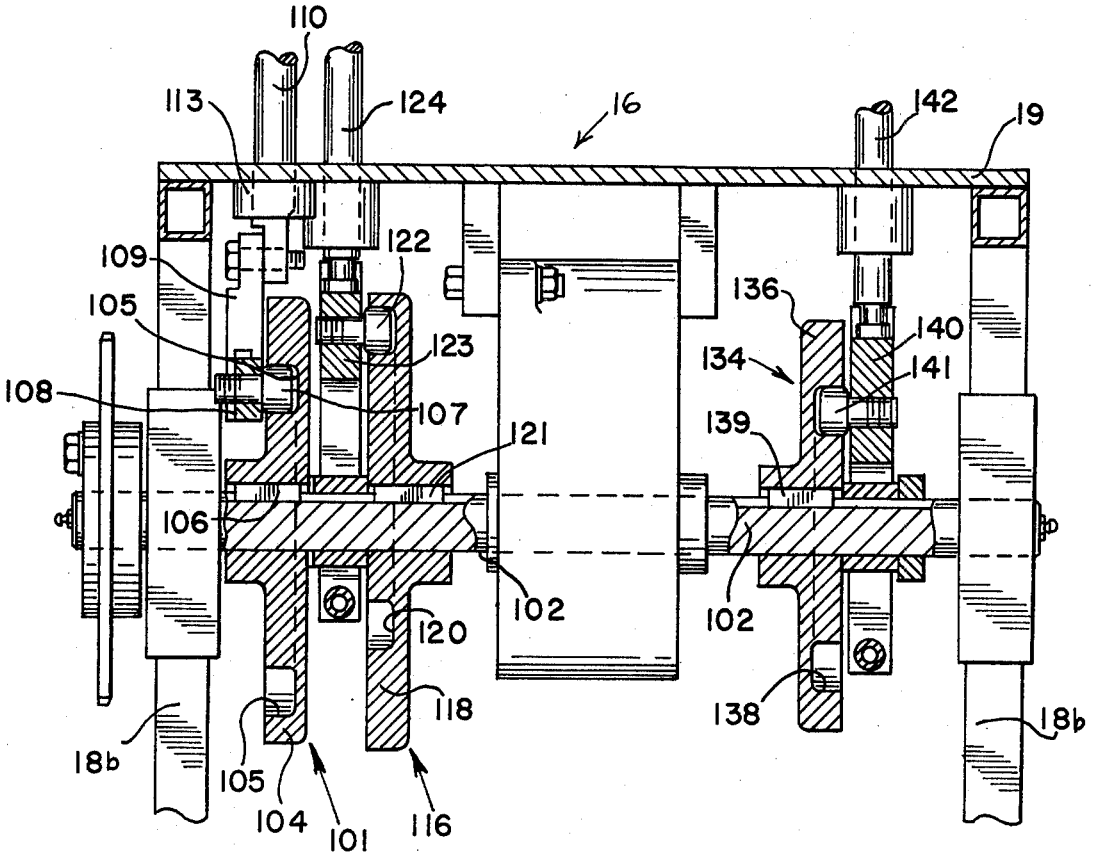

The three cam assemblies which operate the filling pump assembly 28 are shown in detail in FIGS. 9–11 and 16. Each of the above-described cam assemblies is operated from the same horizontal shaft 102 mounted on the lower base **18*b*, as shown in FIG. 16. Shaft 102 is, in turn, rotated directly by drive motor 26 through a cone drive gear reducer 103 and transmission shafts 104. Shaft 102 also drives the sprocket and chain assembly 49, which operates the cup dropper or release mechanism 15. Shaft 102 supports three separate cams, which are designed to operate the various functions of the pumping assembly. As shown in FIG. 9, rotary valve cam 104 is fixedly mounted on shaft 102 by means of a key 106 positioned between corresponding keyways formed in shaft 102 and cam 104. Cam 104 includes an interior recess or cam track 105, which receives a circular cam follower 107. The cam follower 107 is mounted on a cam follower level 108, which is generally horizontal. One end of the cam follower lever 108 is pivotally pinned to the lower base 18*b*. The movement of the cam follower in the cam track raises and lowers the opposite free end of the lever 108 between the solid and dotted line positions shown in FIG. 9. This end of lever 108 is pivotally pinned to a short link 109, which moves not only verticlly with the upward movement of the lever 108, but also horizontally to allow the portion of the rotary valve cam assembly above it to reciprocate horizontally with housing 62. Link 109 is pivotally pinned to the lower end of rod 110, which extends upwardly through a rectangular guide sleeve 113 in top 19 and, in turn, has its upper end pivotally pinned to the lower yoke or ear portion of a push arm 111. The opposite end of push arm 111 is pivotally mounted on a horizontal operating rod 112, which extends along one side of housing 62. One end of the operating rod 112 is inserted through the lower corner of crank member 100, while the opposite end is mounted through the lower corner of a corresponding-shaped support crank 114. Thus, rod 112 is maintained parallel to conveyor belt 14**.

Cam track 105 of the rotary valve cam 104 is generally pear-shaped, as shown in FIG. 9, with the opposite ends of the pear being substantially flat to provide for periods of dwell so that movement of the cam produces only slight vertical movement of the valve cam linkage just described. On opposite sides of the points of equal radius of the cam track, the cam track 105 changes radius rapidly, but similarly to provide identical vertical rise and fall of the linkage. The preferred shape of the cam track will cause the linkage operating the pump cartridge as a valve to move in a harmonic manner, that is, when moving the intake port 90 into position by raising the linkage and rotating the entire assembly clockwise, slow initial positioning takes place, with a rapid final positioning. A period of dwell then occurs, during which the pump cartridge is not rotated. Conversely, when the cartridge has been filled, the cam track causes a reverse harmonic motion in which the linkage rapidly begins to drop to move the discharge port 92 into position.

FIG. 10 shows a pump housing cam assembly generally at 116. Assembly 116 includes a circular cam 118 having an interior recessed cam track 120. Cam 118 is mounted on shaft 102 by means of a key 121. This cam assembly is located just to the inside of rotary valve cam assembly 101, as shown in FIG. 16. The pump housing cam assembly includes a cam follower 122, which is mounted on a vertically disposed housing cam yoke member 123. Member 123 is connected to a shaft 124, which joins the lower cam portion mounted on the lower frame 18*b* to the upper cam linkage portion mounted above the top of the main base 19. Shaft 124 extends upwardly, through a guide sleeve 127, and is pinned at its opposite end to a movable link 125. Link 125, in turn, is pinned to one corner of a generally triangular-shaped cam plate 128, which has a large circular opening formed through it at one corner, by which it is mounted over a fixed shaft 126 mounted beneath and transversely to the conveyor 14. Shaft 126 has its opposite ends fixedly supported in the frame 18*a*. A third, upper corner of cam plate 128 is pivotally pinned to the outward end of a link arm 129, which has its opposite end mounted to a bracket 130 fixedly attached to the lower portion of the pump housing 62.

As the cam follower 122 moves in the cam track 120, it causes the above-described cam assembly linkages to move in a verticl direction so that the cam plate 128 is pivoted on shaft 126, causing it to impart a linear longitudinal movement to the housing 62. Thus, the housing 62 reciprocates along shaft 64 relative to the frame of the packaging assembly at the same speed as the conveyor belt 14 in order to provide accurate filling of the cups 13 and prevent spillage.

The third cam assembly is the pump cam assembly, shown in FIGS. 11 and 16, and generally indicated at 134. Assembly 134 includes a circular cam 136 having an interior cam track 38. The cam 136 is mounted on shaft 102 by means of a key 139. A pump yoke 140, having downwardly extending ear portions positioned over shaft 102, carries a cam follower 141 which is disposed in the cam track 138. The pump yoke 140 is connected to rod 142, which extends vertically upward through a guide sleeve 147, and has its opposite or upward end pivotally pinned to a link 143. The upper end of link 143, in turn, is pivotally pinned to a corner of an L-shaped arm 144. The opposite end of the base of the "L" of this arm 144 has an opening formed therein so that the arm 144 may be pivotally mounted over shaft 126, as shown in FIG. 6. The upper end of L-shaped arm 144 is mounted over a connector rod 145, which extends transversely of the conveyor belt and generally horizontal thereto. The connector rod 145 has a series of parallel arms mounted on it which extend toward the pump pistons 74. These arms 146 have their opposite ends mounted over a connector bar 148, which runs through the outward ends of the pistons. In the operation of pump cam assembly 134, cam 136, as it rotates, urges cam follower 141 in a vertical direction to move the linkages above described upwardly and ultimately cause the pump pistons 74 to be moved in unison reciprocally with respect to the interior of the pump cartridges 68 disposed in the housing 62.

The cam assemblies 116 and 134, as shown in FIGS. 10 and 11, while operating off the same power shaft 102, have their operating linkages located on opposite sides of shaft 126. Lever arms 128 and 144, which are operated, move the housing 62 and pistons 74, respectively, in parallel directions, but at different rates of speed. The housing, moving at the speed of the conveyor, travels approximately three inches, while the pistons, moving at a lesser rate of speed, travel in the same direction. This differential movement, which occurs in both directions, allows sufficient time to discharge and charge the chambers of the pump cartridge, yet permits the effective pumping stroke of the pistons within the cartridges to be on the order of one inch.

All cams are keyed to the main drive through the same shaft 102 and maintain their relativity at any given speed. Thu, if the speed of operation were desired to be increased, the rpm's of shaft 102 would simply need to be increased. On the other hand, if it is desired to extend the length of travel of the housing, the slope of the cam track 118 of housing cam assembly 116 would have to be changed. This would require slope changes in the cam tracks of the pump cam assembly 134 and the rotary valve cam assembly 101. Since all cams are located on the same axis 102, however, by providing each cam with a zero or reference position from which the entire operation may be begun, once the desired cam track shape of one assembly has been selected, the shape of the other cams may be determined by minimal experimentation and calculation.

To briefly describe the operation of the pump filling assembly 28, as the conveyor 14 holding a series of parallel rows of cups 13 is moved under the filling assembly, the housing 62 containing five adjacent pump cartridges 68 having separate fluid volumes, is positioned in an initial or start position, as shown in FIG. 5. In this position, it will be assumed that the pistons have been entirely withdrawn to form three chambers 78 within each of the pump cartridges 68, each of which is equal to the metered volume of fluid which will fill each container 13. In this position, each pump cartridge has also been moved angularly to the position shown in FIG. 8, to communicate the interior of the cartridge with the source of fluid. Immediately upon the last, or in this case, third row of cups reaching a point directly below the corresponding first row of discharge tubes 88, the rotary valve assembly moves to pivot the pump cartridges 68 so that port 92 is in communication with openings 87 and tube 88. At the same time, the housing cam assembly 116 begins moving the housing 62 along the shaft or rail 64 at the same speed as the conveyor belt 14 to maintain each of the fifteen sets of discharge openings 92, 87 and 88 immediately above the respective ones of the containers 13, which had been initially below them. At this same time, the piston cam assembly 134 begins to drive the pistons 74 in a forward direction within the pump cartridges at a lesser speed than housing 62 to forcibly expel the fluent material from the filled chambers formed within these pump cartridges. The housing travels with the conveyor for approximately three to four inches. During that time, the desired metered amount of fluent material contained in each equal volume pump cartridge chamber will have been expelled by the pistons.

After discharge, the rotary valve cam 104 acts to lift its associated linkage to rotate the pump cartridges clockwise, thereby closing port 92 and opening port 90 again. At this moment, the housing cam assembly acts to reciprocate the housing in the opposite direction of the movement of the conveyor, and the pump cam assembly moving the pistons at a slower speed, effectively causes them to "withdraw" toward their first position. The withdrawal of the pistons forms a vacuum in the interior of the pump cartridges 68 which, as port 92 is being closed, draws any remaining fluent material back within the cartridges, thereby preventing any dripping or spillage on the conveyor belt 14. As the passageway 90 becomes aligned with the pump manifold supplying fluent material, this vacuum likewise draws fluent material into the volume being opened by movement of the piston and housing at different speeds.

While this entire process is extremely rapid, the speed at which discharge and refill occur is determined by the replacement that the housing must be ready to move and pumps to discharge as soon as three rows of empty cups are disposed under the housing, in alignment with the three rows of discharge openings.

It is clear tht the number of stepped diameter portions within each pump cartridge 68 could also be increased to allow for filling of more than three rows of cups simultaneously. Likewise, the number of pump cartridges 68 placed transversely across the conveyor and the width of the conveyor could be increased to accommodate more than five cups in each row. It is noted, however, that even the present embodiment provides almost twice the output of filled cups per minute as the prior art. What is essential to the present invention is the provision of a filling pump assembly, which simultaneously fills a number of rows of cups, having a pump cartridge with a separate number of equal volumes formed by the cartridge and a coacting piston, which is moved both longitudinally and angularly in connection with the movement of cups on a belt below it to fill such cups. It is also significant that this invention includes the existence of a timed relationship between the movement of the pump cartridges in both linear and angular directions and the linear movement of a series of pistons relative to the pump cartridges, which facilitates rapid filling without spillage.

Figure 12:
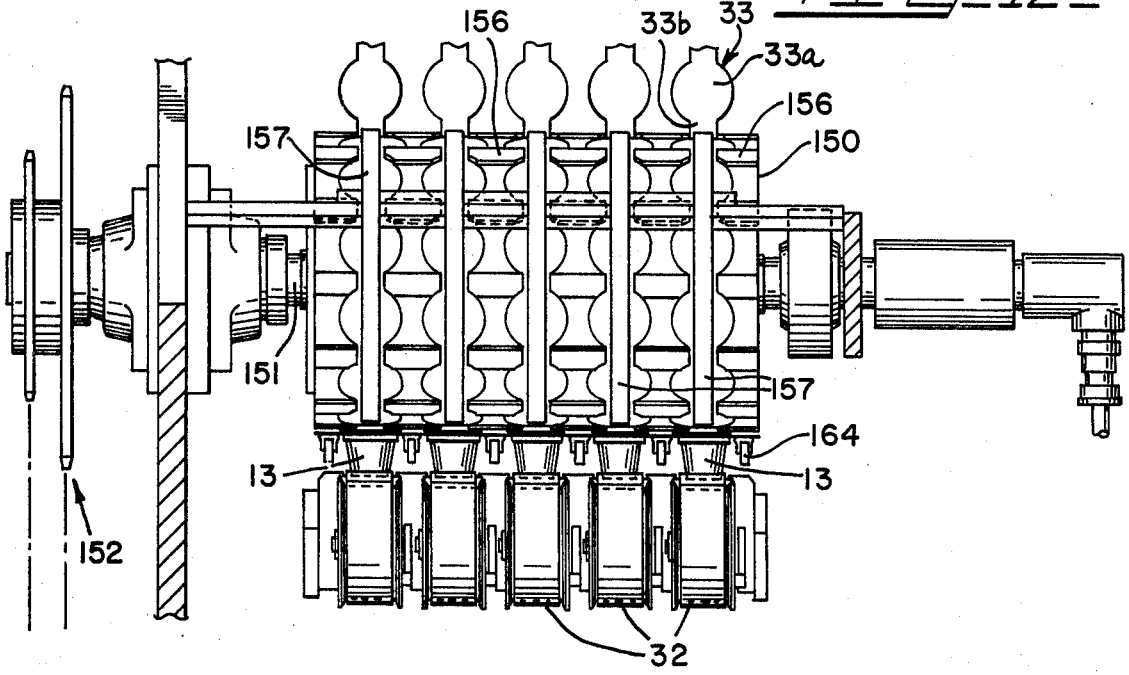
FIG. 12 is an end elevational cross-sectional view of the present invention, taken generally along line 12—12 in FIG. 1, showing the cover applying assembly and, in particular, the heating drum.

The filled containers 13 are next advanced, with the conveyor belt 14, toward a cover applying assembly, shown in general at 30 in FIG. 1 and in more detail in FIG. 12. This cover applying or covering assembly 30 includes a heat drum 150 which is mounted above the surface of the conveyor belt such that its peripheral surface is spaced a short distance above the surface of the conveyor belt 14. The heat drum 150 is mounted for rotation on a central axis or shaft 151, which is driven from a chain and sprocket assembly 152, indicated in general in FIG. 15. This chain and sprocket assembly is, in turn, driven by the central drive motor 26 through gear reducer 103. The heat drum 150 rotates at an angular velocity such that the speed of a point on the surface of the drum is the same as the speed of a point on conveyor belt 14. The surface of the heat drum 150 includes a series of guides 156 extending about the circumference of the drum 150. These guides 156 are formed, as shown in FIG. 12, in a generally wedge shape and are mounted transversely across the surface of the heat drum 150 in a series of circumferentially spaced rows. These guide wedges 156 are spaced on the surface of the drum so that the individual covering strips 33, which consist of a rounded cover portion 33*a* and a linear interconnecting portion 33*b*, may be fed from a series of five adjacent upper storage rollers 35, shown in FIG. 1, around feed guide rollers 37 and threaded onto the heat drum 150 by placing the circular portions 33*a* between guide wedges 156. The wedges have a forward circular edge and a rearward rectangular edge to maintain the covered portion 33*a* adjacent the surface of the heat drum 150. While cover strips 33 are normally maintained adjacent the drum surface by surface tension, spaced fingers 157 may be placed adjacent the curved surface of heat drum 150 to maintain strips 33 adjacent the drum surface.

The interior of the heat drum 150 contains a number of heating elements, which are not shown, that are capable of raising the temperature of the surface of the drum to approximately 300° F, or any sufficient temperature at which the covers may be reliably sealed to the cups. Cover strips 33 are a paper/metallic or paper/-plastic laminate having their outward surface, which is placed adjacent the drum, formed from a non-paper material, while their inward paper surface carries a heat-sensitive adhesive material thereon. As shown in FIG. 1, each circular cover 33*a* is carried about the drum for a distance of approximately 180°, while in contact with the surface of the drum, to assure that the temperature of the cover is uniformly raised sufficiently to permit its tight sealing. As infrared heat lamp 158 may be mounted adjacent and directed toward the surface of the rotating heat drum 150, as shown in FIG. 1, to assure proper over-all heating of the adhesive coated surface of the interconnected covering strips 33. Heating to the proper temperature is important in the application of these coverings since a uniform seal is vital to properly retain the fluent material, maintain acceptable high standards of cleanliness in the packaging operation, and maintain sterility of the product.

As shown in FIG. 12, as the filled cups 13 are moved along the conveyor 14 from the filling station, they reach ribbon conveyors 32, which consist of forward driven pulleys 36 and rearward pulleys 38. Pulleys 36 are mounted on shaft 163, driven by a chain 27, shown in FIG. 15, which operates off a transmission shaft 161 connected to the gear reducer 103 and the drive motor 26. As will be described below, chain 27 is driven by drive sprocket 182, which drives both shaft 25 and shaft 163. This assures that conveyor 14 and conveyor 32 are driven at the same forward speed.

Ribbon conveyors 32 are separate, adjacent conveyor belts, as shown in FIG. 12, which are aligned beneath each longitudinal column of cups 13 on belt 14. These ribbon conveyors 32 are tensioned and raised by a series of ramps 40, under spring tension, placed below the belts 32 and forward of pulley 38. These ramps 40 serve to raise the second conveyor 32, which raises the bottom of the filled cups 13 to lift the cup lips 13*a* slightly above the surface of the conveyor 14. This slight vertical lift brings the sealing lip 13*a* of each cup into pressure contact with the periphery of the heat drum 150 to assure proper sealing engagement between the cover portions 33*a* of strips 33 carried by the heat drum and the upper, sealing lip of the filled cups. A series of rails 164 support the conveyor 14 across this distance to maintain it in proper vertical disposition. The heat drum 150 presses the covers 33*a* on the cups in each row of belt 14 simultaneously, and continues to place consecutive covers on cups aligned in adjacent columns on the conveyor. A peeling knife 166 having a Teflon coated blade is positioned parallel to belt 14 and slightly above the tops of the now covered cups 13. The blade of knife 166 is angled rearwardly and downwardly, as shown in FIG. 1, and acts to positively separate the hot, interconnected cover strip, as applied to the tops of the cups, from the heat drum 150. The applied covers are then pressure-rolled by a roller 167 so that they are positively sealed about the entire surface of the upper lip 13*a* of each cup in a fluid-tight seal. The filled and covered cups are then moved by conveyor 14 on conveyors 32 toward the severing assembly 42.

Figure 13:
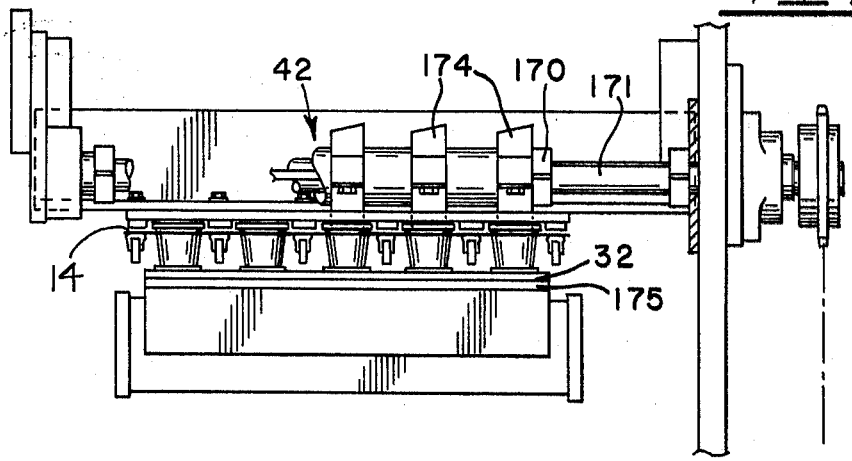
FIG. 13 is an end elevational cross-sectional view of the severing assembly of the present invention, taken generally along line 13—13 in FIG. 1.

The severing assembly 42 includes a cross-shaped, elongated member 170, which rotates about a central axle 171. At the inward end of axle 171 is mounted a sprocket 172 (see FIG. 15), which is driven by a drive chain 173 connected to a sprocket mounted on shaft 151 which also drives the heat drum 150. Thus, the heat drum 150 which applies the covers to the cups, and the severing member 170 which cuts the connecting portion 33*b* between the circular portions 33*a* of the covers 33, are driven at related speeds determined by their proportions. Four severing blades 174 are mounted about the circumference of the severing drum, by positioning the flat side of a blade adjacent successive legs of the cross-shaped member 170 so that the blades extend outwardly from the severing member at an angle which will be generally perpendicular to the surface of the conveyor 14. The filled and covered cups are moved on conveyor 32 at a slight upward angle because the radius of the forward driving pulley 36 is larger than the free-running rearward pulley 38, and also because a ramp 175 is located under the lower surface of pulley 32 at a slightly upwardly directed angle. The cups are moved in this slight upward direction to improve the cutting angle between the rotating blades 174 and the flat surface of the interconnecting portions 33*b* of strips 33. As cups 13, covered but connected by strips 33, are moved under the rotating member 170, the blades 174 engage the linear connecting portion 33*b* and sever such portions between individual ones of the filled cups. As shown in FIG. 13, the blades are also slightly angulated to improve cutting. Proper proportioning of sprockets 172 and 175, as shown in FIG. 15, will cause axle 171 to rotate at a speed similarly proportionate to the speed of rotation of shaft 151 such that axle 171 will make one complete revolution for every four covers applied by the heat drum 150 rotating on shaft 151. Thus, with proper initial indexing of heat drum 150 and severing member 170 relative to one another, proper severing of strips 33, between cups, is assured.

Following the severing operation, the filled, covered, individual cups are moved by conveyor 14 over an upwardly directed ramp 180 and between the sides of a guide chute 181 until they reach a downwardly directed discharge ramp 44, which discharges the cups into a barrel, container, box, or further equipment to package them for shipment.

Figure 14:
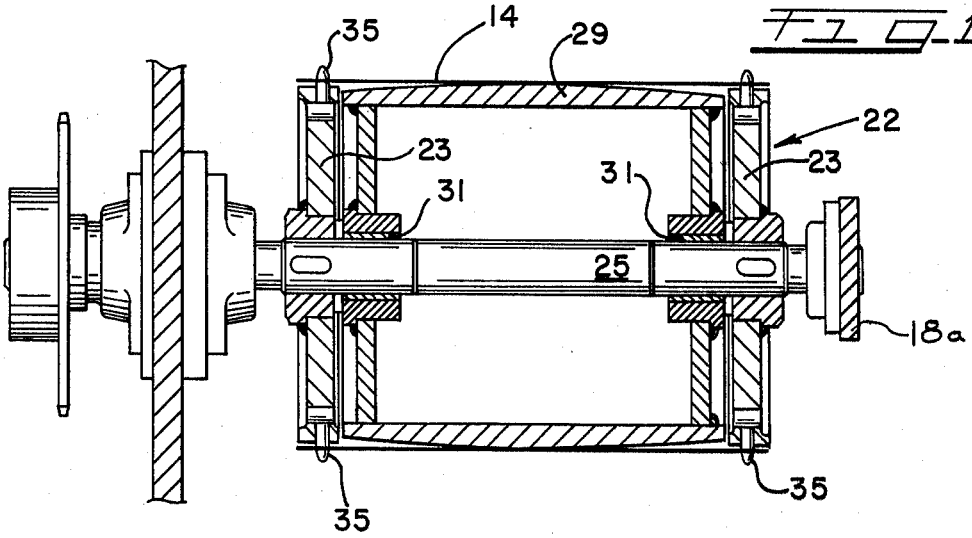
FIG. 14 is an elevational cross-sectional view of the drive pulley of the present invention, taken generally along line 14—14 in FIG. 1.

FIG. 14 illustrates the unique conveyor drive assembly 22, of the present invention, which drives the conveyor belt 14. This drive assembly 22 includes a pair of spaced apart, parallel drive sprockets 23 mounted on a shaft 25 which has its ends journaled in bearings in a conventional manner for rotation in the frame 18*a*. One end of shaft 25 is attached by a chain assembly 27 to sprocket 182, as shown in FIG. 15. The drive sprockets 23 are separated from one another by an interior idler drum 29, which is mounted on shaft 25 by bearings 31 which allow it to rotate freely with respect to shaft 25. Sprockets 23 are fixedly mounted on shaft 25. The radius of each sprocket 23 is less than the radius of idler drum 29, such that idler drum 29 supports or bears the weight of the conveyor belt 14. Each sprocket 23 has a series of pins 35 extending outwardly about its peripheral surface. These outwardly extending pins 35 engage a corresponding series of holes 37 formed in the outside margins of conveyor 14. Such holes 37 are shown in FIG. 5. Pins 35 engage holes 37 and thereby drive belt 14. The idler drum 29 is formed with a slight crown of approximately 0.006 inch relative to the outside edges of the drum. This crown provides the proper degree of tension on the conveyor 14 and, with pins 35, assures that the belt 14 will run linearly, rather than sliding toward the side of the drive assembly. The use of the idler drum 29 to assume the load and tension of the belt 14 and the use of pins 35 to engage the belt 14 allows for slight adjustments or compensations for inaccuracies in belt sizes and tolerance without affecting the required uniform, continuous movement of the conveyor 14.

While the operation of the above packaging apparatus has been explained in connection with a series of operations, it can be easily seen that these operations are integrally related to one another to perform smoothly in a matter of seconds to produce a finished product. The above-described packaging apparatus, with consecutive rows of openings formed in the belt, with five openings in each row, may be operated to feed, fill and seal approximately 1,000 cups per minute.

As can be appreciated from FIG. 15, each of the operations described above is powered from a single motor 26 acting through a series of gears or chains and sprockets, which are proportioned relative to one another so that the operations are performed in the exact sequence and in a desired timed relationship to one another. Such timed relationships between operations are easily determined and accomplished since the gear ratios of the transmission gears and drive reducers are known, and the necessary relative sizes of the various sprockets may be determined by proportioning their radii relative to one another. For example, sprockets 182 and 183, shown in FIG. 15, operate at a 1:1 ratio with one another since they have the same radius, while sprockets 182 and 184 are in the ratio of 2:5. However, since the pulleys 36 carrying ribbon conveyors 32 are approximately two and one-half times smaller than the drive sprockets 23 carrying conveyor 14, the speed at which a point on the surface of each conveyor is moved is substantially equal.

Upon consideration of the foregoing, it will become apparent to those skilled in the art that various modifications may be made in the subject invention without departing from the spirit of the invention embodied herein. Therefore, only such limitations should be imposed as are indicated by the spirit and scope of the following claims.

We claim:

1. An apparatus for packaging a predetermined volume of fluent material in individual containers, including movable conveyor means, means for positioning a plurality of said individual containers on said conveyor means in a series of longitudinally spaced, transversely extending rows, a filling means for automatically filling each of said individual containers positioned on said conveyor means and located within a plurality of said transversely extending rows simultaneously with a precisely metered volume of said fluent material as said containers are moved by said conveyor means, said filling means including pumping means reciprocally movable along a definite path adjacent said conveyor means, said pumping means having a plurality of pumping cartridges, one of said pumping cartridges being associated with each of a longitudinal series of containers disposed on said conveyor means, each of said pumping cartridges having a pumping piston associated therewith to define a plurality of discrete pumping chambers within each of said pumping cartridges and movable relative to said associated pumping cartridge to fill said longitudinal series of containers associated therewith, and a covering means for applying covering material fluid-tightly to a plurality of said filled containers simultaneously as said containers are moved by said conveyor means.

2. The apparatus for packaging a predetermined volume of fluent material in individual containers of claim 1 wherein said covering material includes continuous strips of interconnected preformed caps, one cap in each of said strips being applied to each individual filled container contained within a row on said conveyor means, to fluid-tightly seal said containers as said containers are moved on said conveyor means, said apparatus for packaging also including a severing means for simultaneously cutting each of said interconnected strips between said caps applied to said individual, filled containers as said containers are moved by said conveyor means.

3. An apparatus for packaging a predetermined volume of fluent material in individual containers, including movable conveyor means, means for positioning a plurality of said individual containers on said conveyor means in a series of longitudinally spaced, transversely extending rows, a filling means for automatically filling each of said individual containers positioned on said conveyor means and located within a plurality of said transversely extending rows simultaneously with a precisely metered volume of said fluent material as said containers are moved by said conveyor means, and a covering means for applying covering material fluid-tightly to a plurality of said filled containers simultaneously as said containers are moved by said conveyor means, said filling means including a filling pump assembly having a housing disposed over the path of travel of said conveyor means, a plurality of generally hollow pumping cartridges mounted on said housing and movable therewith along the path of travel of said conveyor means, a plurality of pumping pistons, each of said pumping pistons being associated with and at least partially disposed for movement within a separate one of said pumping cartridges, each of said pumping cartridges cooperating with said one of said pumping pistons associated therewith to define a plurality of discrete pumping chambers of approximately equal volume within each of said pumping cartridges, said pumping chamber and said associated piston being movable in parallel directions relative to one another at different speeds along the path of travel of said conveyor means, each of said pumping cartridges being angularly movable relative to said housing and openings for supplying and discharging fluent material formed therein, such that each of said pumping chambers formed in each of said pumping cartridges is adapted to receive said fluent material from said openings for supplying said fluent material and thereafter discharge said fluent material through said openings for discharging said fluent material, in response to the relative movement of said piston and said cartridge, to fill said individual containers disposed on said conveyor means.

4. The apparatus for packaging fluent material of claim 3 wherein said generally hollow interior of each of said pumping cartridges includes a series of stepped diameter interior portions, and each of said pumping pistons has an exterior configuration formed by a series of correspondingly stepped exterior diameters slightly smaller in dimension than said stepped diameters of said interior portions of each of said pumping cartridges, each of said pumping pistons being insertable into each of said associated pumping cartridges.

5. The apparatus for packaging fluent material of claim 4 wherein the dimensions of each of said pumping chambers formed by each of said pumping cartridges and each of said associated pumping pistons are proportioned relative to one another such that the maximum volume of fluent material which may be received within each of said pumping chambers of any pumping cartridge is approximately equal.

6. The apparatus for packaging fluent material in individual containers of claim 3 wherein each pumping cartridge is moved angularly relative to said housing for controlling the flow of said fluent material into and out of each of said pumping chambers, each of said pumping cartridges being moved angularly relative to said housing in unison and in timed relationship to the movement of said pumping piston and said housing relative to one another along said path of travel of said conveyor means to thereby communicate each of said pumping chambers with a source of fluent material while preventing discharge therefrom to said individual containers on said conveyor means and, alternately, to close each of said pumping chambers to said source of fluent material while allowing discharge of said fluent material therefrom to fill said individual containers.

7. The apparatus for packaging fluent material in individual containers of claim 3 wherein said housing is mounted on a frame for reciprocal movement along a pair of parallel, spaced apart rails extending along the path of travel of said conveyor means, said rails positioning said housing above a portion of said conveyor means carrying said individual containers, and wherein a housing cam arrangement operatively connects a drive means to said housing to cause said housing to move in reciprocal fashion along said rails, a piston cam arrangement operatively connects said drive means to said pumping pistons to cause said pistons to move reciprocally relative to said conveyor means and said housing, and a rotary valve cam arrangement operatively connects said drive means to said pumping cartridges to cause said pumping cartridges to be moved angularly relative to said housing to control the flow of said fluent material to and from said pumping chambers defined by said pump cartridges and said associated pistons in timed relationship to the movement of said housing and said pistons.

8. The apparatus for packaging fluent material in individual container of claim 7 wherein said housing cam arrangement, aid piston cam arrangement and said rotary valve cam arrangement are connected to said common drive means in such a manner that a timed relationship exists between the operation of said housing cam arrangement, said piston cam arrangement and said rotary valve cam arrangement such that when said housing is located in a first position relative to said rails, each of said pumping cartridges is angularly positioned, relative to said housing, to communicate said pumping chambers formed therein with a source of fluent material to fill said pumping chambers with said fluent material, said pumping cartridges being thereafter angularly moved by said rotary valve cam arrangement to close communication between said source of fluent material and said pumping chambers while opening communication between said pumping chambers and said individual containers located on said moving conveyor means, said housing cam arrangement simultaneously causing said housing to be moved along said rails from said first position toward a second position at a speed substantially similar to the speed of movement of said conveyor means, said pumping pistons being simultaneously moved by said pumping cam arrangement in a direction parallel to the direction of movement of said housing at a different speed to rapidly reduce the volume of said pumping chambers within each of said pumping cartridges and thereby expel said fluent material therefrom, said housing cam arrangement causing said housing, upon reaching said second position relative to said rails, to reverse its direction relative to said rails and return to said first position, said piston cam arrangement simultaneously causing said pistons to reverse their direction of movement and withdraw from said pumping cartridges to thereby return said pumping chambers to their initial volumes achieved in said first position of said housing, creating a vacuum within said pumping chambers which assists in immediately stopping the flow of said fluent material from said pumping chambers, said rotary valve cam arrangement simultaneously causing said pumping cartridges to be moved angularly relative to said housing to close communication of said pumping chambers with said individual containers and again open communication to said source of fluent material.

9. The apparatus for packaging fluent material in individual containers of claim 3 wherein the number of said pumping cartridges used in said filling pump assembly is equal to the number of individual containers capable of being disposed in a row on said conveyor means, each of said pumping cartridges being capable of filling individual ones of said containers located in a plurality of such rows on said conveyor with substantially equal volumes of fluent material simultaneously.

10. The apparatus for packaging fluent material of claim 2 wherein aid severing means includes an elongated member, rotatable about a central axis thereof and positioned for rotation above the surface of said conveyor means subsequent to the point on said conveyor means at which said containers are filled with fluent material and covered, said elongated member having a series of outwardly extending blades mounted in angularly spaced relationship therearound, said blades, upon rotation of said elongated member, acting to contact and sever each of said continuous strips of interconnected caps between said filled containers to form separate individual filled and sealed containers of said fluent material.

11. An apparatus for packaging a predetermined volume of fluent material in individual containers, including movable conveyor means, means for positioning a plurality of aid individual containers on said conveyor means in a series of longitudinally spaced, transversely extending rows, a filling means for automatically filling each of said individual containers positioned on said conveyor means and located within a plurality of said transversely extending rows simultaneously with a precisely metered volume of said fluent material as said containers are moved by said conveyor meams, and a covering means for applying covering material fluid-tightly to a plurality of said filled containers simultaneously as said containers are moved by said conveyor means, said means for positioning a plurality of individual containers on said conveyor means including a pair of parallel, spaced apart rollers, positioned beneath a series of adjacent columns of stacked, or nested containers above said conveyor means, each of said rollers having a series of arcuate surfaces formed therein along the length thereof, corresponding arcuate surfaces of opposing rollers being disposed facing one another to form a series of cup drop openings positioned to receive the lowermost container in each of said adjacent stacks of said containers and to transfer said container to the surface of said conveyor means, said parallel rollers being operatively connected to a container dispenser cam arrangement, said dispenser cam arrangement causing said rollers to be pivotally moved about central axes thereof in a manner such that said rollers oscillate between a takeoff position and a delivery position in a generally harmonic manner to provide for accurate deposit of said containers on said conveyor means while minimizing the time required to return said rollers from said delivery position to said takeoff position.

12. An apparatus for packaging a predetermined volume of fluent material in individual containers, including movable conveyor means, means for positioning a plurality of said individual containers on said conveyor means in a series of longitudinally spaced, transversely extending rows, a filling means for automatically filling each of said individual containers positioned on said conveyor means and located within a plurality of said transversely extending rows simultaneously with a precisely metered volume of said fluent material as said containers are moved by said conveyor means, and a covering means for applying covering material fluid-tightly to a plurality of said filled container simultaneously as said containers are moved by said conveyor means, said covering means for applying covering material fluid-tightly to a plurality of filled containers simultaneously including a generally cylindrical heating drum mounted above and transverse to the path of travel of said conveyor means, said heating drum heating elements associated therewith, effective to heat an exterior surface of said heating drum to a desired temperature, said exterior surface of said heating drum having guide means associated therewith for maintaining a plurality of said continuous strips of said covering material, fed to said heating drum in side-by-side relationship, against said exterior surface of said heating drum over a distance of approximately half the circumference of said heating drum prior to application of said covering material to said containers to provide for sufficient overall heating of said strips of said covering material to assure proper sealing of said covering material to said containers.

13. The apparatus for packaging fluent material of claim 12 wherein stripping means is mounted adjacent said heating drum above the path of travel of said conveyor means to positively engage and remove any portion of said continuous strips of covering material which may tend to adhere to said exterior surface of said heating drum after its application to said individual, filled containers passing therebelow.

14. The apparatus for packaging fluent material of claim 12 wherein a radiant heating means is associated with said heating drum and directed toward the exterior surface thereof to allow additional heating of an adhesive surface of said covering material in a uniform manner.

15. An apparatus for packaging a predetermined volume of fluent material in individual containers, including movable conveyor means, means for positioning a plurality of said individual containers on said conveyor means in a series of longitudinally spaced, transversely extending rows, a filling means for automatically filling each of said individual containers positioned on said conveyor means and located within a plurality of said transversely extending rows simultaneously with a precisely metered volume of said fluent material as said containers are moved by said conveyor means, and a covering means for applying covering material fluid-tightly to a plurality of said filled containers simultaneously as said containers are moved by said conveyor means, said conveyor means including an endless conveyor belt having a plurality of openings formed therein, said openings adapted to receive and support said individual containers for filling, a follower pulley supporting one end of said conveyor belt, and a drive pulley assembly supporting the opposite end of said conveyor belt, said conveyor belt being positioned over said pulleys for movement therearound, each of said pulleys being rotatable round a central axis thereof, said drive pulley assembly having an independent, free rotating idler drum and a pair of circular drive sprockets mounted on opposite sides of said idler drum, each of said drive sprockets having a series of pins mounted thereon in angularly spaced relationship about the circumference thereof, said pins engaging correspondingly spaced openings formed in said conveyor belt such that upon rotation of said drive sprockets, said pins engaging said conveyor belt will cause said conveyor belt to be moved relative to said packaging apparatus.

16. The apparatus for packaging fluent material of claim 15 wherein said idler drum has a greater diameter than the diameter of each of said drive sprockets, such that said idler drum supports said one of said conveyor belt, said idler drum additionally having a slightly greater diameter at its middle than at its outside edges to form a slight crown which assists in maintaining proper positioning of said conveyor belt relative to said packaging apparatus to assure linear travel of the conveyor belt.

17. In an apparatus for packaging fluent material having a means for delivering predetermined volumes of said fluent material to individual containers, the improvement including a filling pump assembly having a housing disposed over the path of travel of a conveyor means bearing an arrangement off said individual containers, a plurality of generally hollow pumping cartridges mounted within said housing and movable therewith along the path of travel of said conveyor means, a plurality of pumping pistons, each of said pumping pistons being associated with, and at least partially disposed for movement within, a separate one of said pumping cartridges, each of said pumping cartridges cooperating with said pumping piston associated therewith to define a plurality of pumping chambers of approximately equal volume within each of said pumping cartridges, said pumping cartridge and said associated piston being movable in parallel directions relative to one another, along the path of travel of said conveyor means, each of said pumping cartridges being angularly movable relative to said housing and openings for supplying and discharging fluent material formed therein, such that each of said pumping chambers formed in each of said pumping cartridges may be moved to receive said fluent material through ones of said openings for supplying said fluent material and thereafter discharge said fluent material through others of said openings for discharging said fluent material to fill said individual containers disposed on said conveyor means in response to the relative movement of said pistons and said pumping cartridges.

18. The improvement set forth in claim 17 wherein said generally hollow interior of each of said pumping cartridges includes a series of stepped diameter interior portions, and each of said pumping pistons has an exterior configuration formed by a series of correspondingly stepped exterior diameters slightly smaller in dimension than said stepped diameters of said interior portions of each of said pumping cartridges, each of said pumping pistons being insertable into each of said associated pumping cartridges.

19. The improvement set forth in claim 17 wherein each pumping cartridge is moved angularly relative to said housing for controlling the flow of said fluent material into and out of each of said pumping chambers, each of said pumping cartridges being moved angularly relative to said housing in unison and in timed relationship to the movement of said pumping piston and said housing relative to one another along said path of travel of said conveyor means to thereby communicate each of said pumping chambers with a source of fluent material while preventing discharge therefrom to said individual containers on said conveyor means and, alternatively, to close each of said pumping chambers to said source of fluent material while allowing discharge of said fluent material therefrom to fill said individual containers.

20. The improvement set forth in claim 17 wherein the number of said pumping cartridges used in said filling pump assembly is equal to the number of individual containers capable of being disposed in a row on said conveyor means, each of said pumping cartridges being capable of filling individual ones of said containers located in a plurality of such rows on said conveyor with substantially equal volumes of fluent material simultaneously.

21. In an apparatus for packaging predetermined volumes of fluent material, having a means for applying covering material fluid-tightly to a plurality of filled, individual containers simultenously, the improvement including a generally cylindrical heating drum mounted above and transverse to the path of travel of a conveyor having a plurality of said filled container disposed thereon, said heating drum having heating elements associated therewith, effective to heat an exterior surface of said heating drum having guide means associated therewith for maintaining a plurality of continuous strips of said covering material, fed to said heating drum in side-by-side relationship, against said exterior surface of said heating drum over a distance of approximately half the circumference of said heating drum prior to application of said covering material to said containers to provide for sufficient over-all heating of said strips of said covering material to assure proper sealing of said covering material to said containers.

22. The improvement set forth in claim 21 wherein stripping means is mounted adjacent said heating drum above the path of travel of said conveyor means to positively engage and remove any portion of said continuous strips of covering material which may tend to adhere to said exterior surface of said heating drum after application to said individual, filled containers passing therebelow.

23. The improvement set forth in claim 21 wherein said guide means includes a plurality of chips mounted in spaced relationship about said exterior surface of said heating drum to engage and hold preformed circular portions of said strips of covering material adjacent said exterior surface of said heating drum.

24. In an aparatus for packaging predetermined volumes of fluent material in individual containers, having an endless conveyor belt having a plurality of openings formed therein, said openings adapted to receive and support said individual containers for filling, the improvement including a follower pulley supporting one end of said conveyor belt, and a drive pulley assembly supporting the opposite end of said conveyor belt, said conveyor belt being positioned over said pulleys for movement therearound, each of said pulleys being rotatable around a central axis thereof, said drive pulley assembly having an independent, free rotating idler drum and a pair of circular drive sprockets mounted on opposite sides of said idler drum, each of said drive sprockets having a series of pins mounted thereof in angularly spaced relationship about the circumference thereof, said pins engaging correspondingly spaced openings formed in said conveyor belt such that upon rotation of said drive sprockets, said pins engaging said conveyor belt will cause said conveyor belt to be moved relative to said packaging apparatus.

25. The improvement set forth in claim 24 wherein said idler drum has a greater diameter than the diameter of each of said drive sprockets, such that said idler drum supports said one end of said conveyor belt, said idler drum additionally having a slightly greater diamter at its middle than at its outside edges to form a slight crown which assists in maintaining proper positioning of said conveyor belt relative to said packaging apparatus to assure linear travel conveyor belt.

26. A method of packaging predetermined volumes of fluent material in individual containers comprising the steps of:

continuously moving a plurality of said containers along a first path of travel, said containers being arranged in longitudinally spaced, transversely extending rows, said containers being moved beneath a filling pump assembly having a plurality of generally hollow pumping cartridges mounted above said first path of travel of said conveyor means, each of said cartridges being associated with a separate longitudinal series of said containers, and a plurality of pumping pistons, each of said pumping pistons being associated with a separate one of said pumping cartridges to define discrete pumping chambers within each of said pumping cartridges;

moving each of said associated pumping cartridges and pumping pistons relative to said first path of travel of said conveyor means and to one another and thereby filling each of said containers located in more than one of said longitudinally spaced, transversely extending rows with a predetermined, approximately equal volume of fluent material simultaneously; and, fluid-tightly covering each of said filled containers.

27. The method of packaging predetermined volumes of fluent material in individual containers of claim 26 wherein said step of covering said individual, filled containers includes the steps of:

feeding a series of interconnected, preformed caps along parallel second paths of travel, said second paths of travel coinciding at a terminal point thereof with said first path of travel, along which said containers are moved;

heating said interconnected strips of caps as they are fed along said second paths of travel;

applying said heated strips of caps successively to individual, filled containers moving along said first path of travel under pressure, thereby fluid-tightly sealing said caps to said containers; and, severing successive ones of said caps from said interconnected strips to form discrete, covered containers filled with approximately equal volumes of said fluent material.

* * * * *

UNITED STATES PATENT OFFICE

CERTIFICATE OF CORRECTION

PATENT NO. : 4,077,180

DATED : March 7, 1978

INVENTOR(S) : J. Richard Agent, Donald W. Nielsen, Thomas A. Cooper

It is certified that error appears in the above-identified patent and that said Letters Patent are hereby corrected as shown below:

In Column 10, line 25, change "level" to -- lever --.

In Column 10, line 32, change "verticlly" to -- vertically --.

In Column 11, line 5, after "assembly", insert -- 116 --.

In Column 11, line 25, change "verticl" to -- vertical --.

In Column 11, line 35, change "38" to -- 138 --.

In Column 12, line 9, change "Thu" to -- Thus --.

In Column 13, line 8, change "replacement" to -- requirement --.

In Column 13, line 12, change "tht" to -- that --.

Claim 8 (Column 18, line 45) change "container" to -- containers --.

Claim 8 (Column 18, line 46) change "aid" to -- said --.

Claim 10 (Column 19, line 31) change "aid" to -- said --.

Claim 11 (Column 19, line 47) change "aid" to -- said --.

Claim 11 (Column 19, line 54) change "meams" to -- means --.

Claim 12 (Column 20, line 23) change "container" to -- containers --.

Claim 12 (Column 20, line 29) change "heating drum heat-" to -- heating drum having heat- --.

UNITED STATES PATENT OFFICE

CERTIFICATE OF CORRECTION

PATENT NO. : 4,077,180

DATED : March 7, 1978

INVENTOR(S) : J. Richard Agent, Donald W. Nielsen, Thomas A. Cooper

It is certified that error appears in the above-identified patent and that said Letters Patent are hereby corrected as shown below:

Claim 15 (Column 21, line 11) change "round" to -- around --.

Claim 17 (Column 21, line 37) change "off" to -- of --.

Claim 23 (Column 22, line 57) change "chips" to -- clips --.

Claim 24 (Column 23, line 8) change "thereof" to -- thereon --.

Claim 25 (Column 23, line 19) change "diamter" to -- diameter --.

Claim 25 (Column 23, line 23) change "travel conveyor" to -- travel of the conveyor --.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*